US007150305B2

(12) United States Patent
Yaw

(10) Patent No.: US 7,150,305 B2
(45) Date of Patent: Dec. 19, 2006

(54) CURTAIN

(75) Inventor: Larry Yaw, Taichung (TW)

(73) Assignee: Union Looper Co., Ltd., Taichung (TW)

( * ) Notice: Subject to any disclaimer, the term of this patent is extended or adjusted under 35 U.S.C. 154(b) by 0 days.

(21) Appl. No.: 10/900,298

(22) Filed: Jul. 28, 2004

(65) Prior Publication Data

US 2006/0021720 A1 Feb. 2, 2006

(51) Int. Cl.
*A47H 5/00* (2006.01)

(52) U.S. Cl. ..... 160/84.04; 160/DIG. 7

(58) Field of Classification Search ..... 160/84.04, 160/84.01, 84.05, 321, DIG. 7, 84.06, 237, 160/238
See application file for complete search history.

(56) References Cited

U.S. PATENT DOCUMENTS 2,065,402 A * 12/1936 Schweller ..... 428/164
2,577,046 A * 12/1951 Svirsky ..... 160/321
3,615,970 A * 10/1971 May ..... 156/78
3,696,845 A * 10/1972 Acker et al. ..... 139/383 R
4,002,188 A * 1/1977 Hanks ..... 139/420 R
4,377,195 A * 3/1983 Weil ..... 160/237
4,587,997 A * 5/1986 Brooks ..... 139/420 R
4,934,435 A * 6/1990 Regev ..... 160/84.04
6,397,920 B1 * 6/2002 Forin ..... 160/238
6,672,361 B1 * 1/2004 Fransen ..... 160/85

* cited by examiner

*Primary Examiner*—David M. Purol
(74) *Attorney, Agent, or Firm*—Troxell Law Office, PLLC

(57) ABSTRACT

A curtain including a fixing rod and a curtain body. The fixing rod is secured to an upper side of a window frame and includes a winding shaft located on an interior and an endless bead string movably wound on one end of the winding shaft. The curtain body is made of a plurality of flexible strings intertwined with one another to form a plurality string circles and pores of various sizes between the string circles. The upper end of the curtain body is fixed on the winding shaft so that the curtain body may be moved up and down by rotation of the winding shaft by pulling the bead string. The pores let the curtain body have a predetermined airiness and allow light to pass through.

5 Claims, 5 Drawing Sheets

CURTAIN

BACKGROUND OF THE INVENTION

1. Field of the Invention

The invention relates to a curtain, particularly to one having a plurality of pores to produce an airy and light-passing effect in addition to a sound insulating function.

2. Description of the Prior Art

Many styles of curtains are widely used, such as a winding type, a pulling type, and a Venetian, made of cloth to provide a blocking function for sunlight to prevent furniture from gradually deforming or disfiguring due to sunlight, and keeping a room temperature from getting higher at the same time, so persons in a room may feel comfortable.

However, conventional curtains generally have the following disadvantages.

1. A curtain body has tiny pores to cause deficient airiness so ventilation is very bad. Especially, if it is woven with a high density, the curtain provides less ventilation.

2. A curtain body has tiny pores capable of blocking light from shining in, so if light is needed, the curtain cannot be used, and if the curtain is half opened to let light or air in, privacy is reduced.

3. Conventional curtain material does not provide a sound absorbing function.

4. Conventional curtain bodies are generally made of a material having a small specific gravity, which is subject to wind blowing and the curtain body is easily broken or things in a room can be blown down by a wind or break.

SUMMARY OF THE INVENTION

This invention has been devised to offer a curtain having a fixed rod and a curtain body. The fixing rod is located at an upper side of a window frame, and the curtain body is made of a large number of flexible threads intertwined with a plurality of irregular solid thread circles and pores formed. The upper end of the curtain body is connected on a winding shaft of the fixing rod.

The curtain according to the present invention has proper airiness and allows light to pass due to the well. In addition, the curtain body can be wound up and down.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
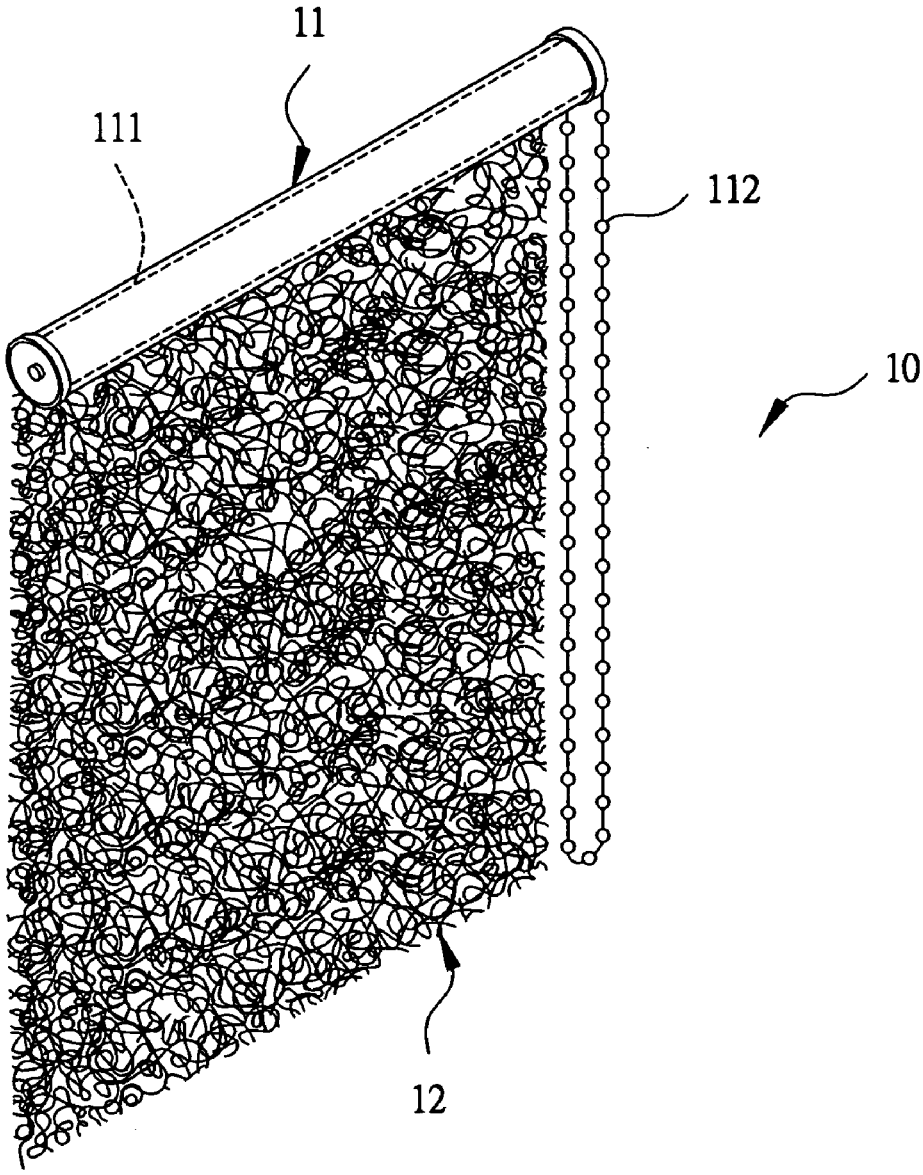
FIG. 1 is a perspective view of a first embodiment of a curtain of the present invention.
Figure 2:
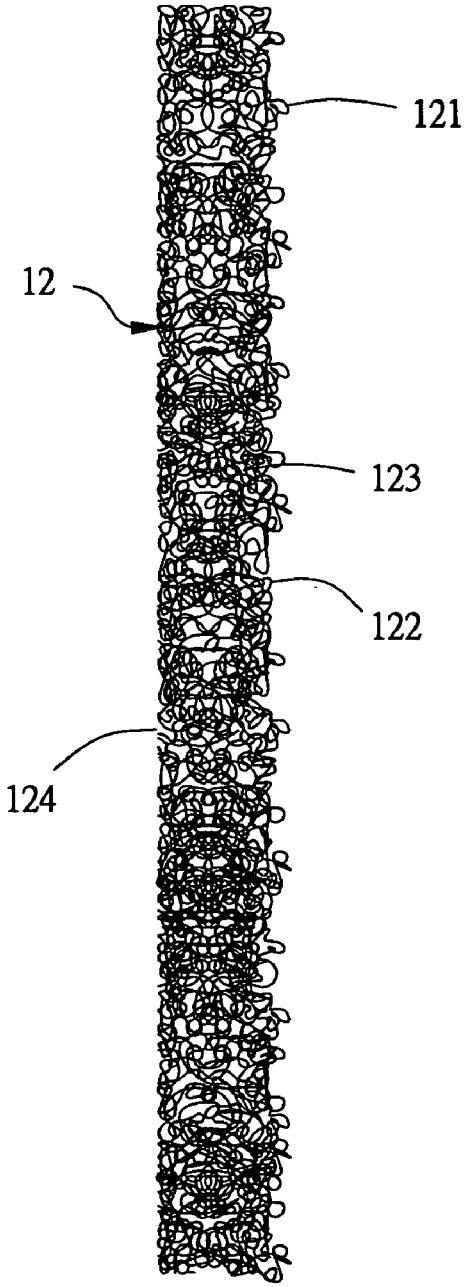
FIG. 2 is a side view of a curtain body in the first embodiment of the curtain of the present invention.

A preferred embodiment of a curtain in the present invention, as shown in FIGS. 1 and 2, includes a fixing rod 11 and a curtain body 12 combined together.

The fixing rod 11 is secured to an upper side of a window frame (not shown). The fixing rod 11 includes a winding shaft 111 and an endless bead string 112 wounded around one end of the winding shaft 111 so as to rotate the winding shaft 111 and consequently move the curtain body up and down.

The curtain body 12 is made of many flexible threads 121 intertwined to form a plurality of irregular thread circles or loops 122 and a plurality of pores 123 of different sizes formed between the circles 122. One surface of the curtain body 12 is pressed with heat to become a flat surface 124 so as to decrease the number of the plurality of pores 123 so light passing through the pores 123 may be lessened. Moreover, the other surface of the curtain body 12 is irregular or uneven, still having a large area for sunlight to pass through with the plurality of pores 123 all intact. At the same time, the curtain body 12 has a comparatively large specific gravity, enabling the curtain body 12 to move down naturally and smoothly, and preventing it from being blown by a wind to swing wildly.

The curtain 10 in the invention can be operated in almost the same way as the conventional one, by pulling the bead string 112 to rotate the winding shaft 111 and to move the curtain body 12 up and down.

Figure 3:
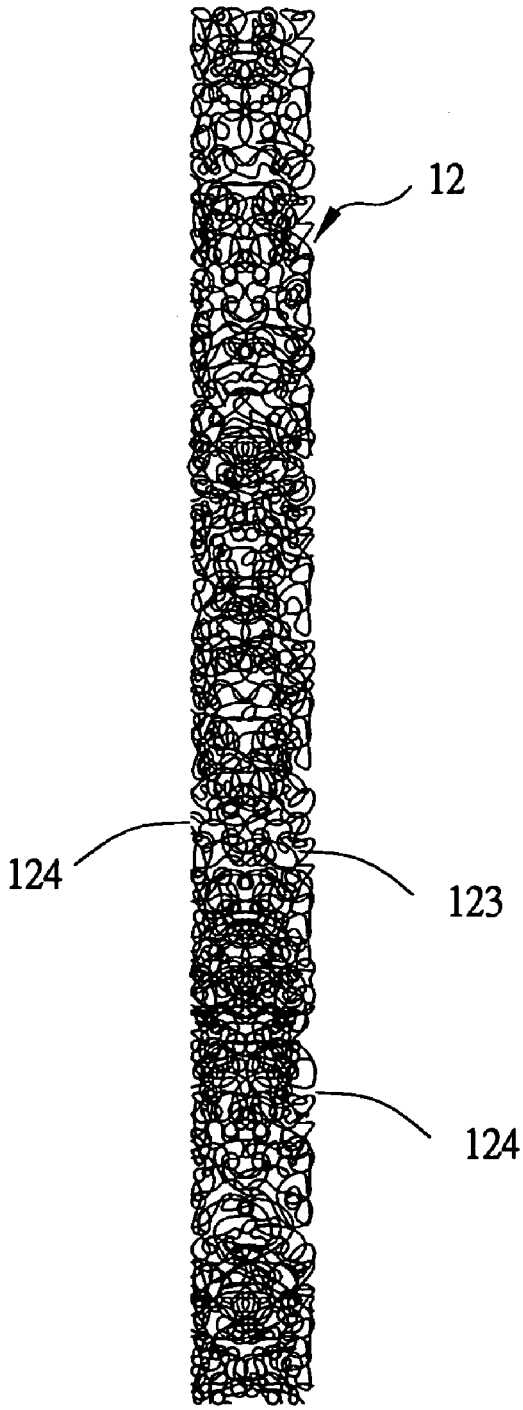
FIG. 3 is a side view of a curtain body in a second embodiment of a curtain of the present invention.

In addition, FIG. 3 shows a curtain body 12 of a second embodiment of a curtain in the invention, having two surfaces of the curtain body 12 pressed with heat to become two flat surfaces 124 so that the pores 123 in the two surfaces 124 are decreased to minimize a size of the plurality of pores 123 and restrict sunlight passing through so that the curtain body 12 may have a light blocking effect, which is applicable to buildings receiving strong sunlight.

Figure 4:
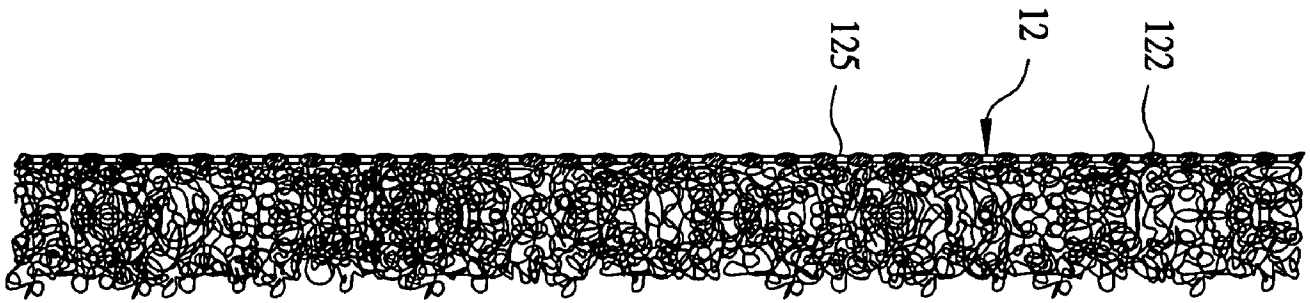
FIG. 4 is a side view of a curtain body in a third embodiment of a curtain of the present invention.

Next, FIG. 4 shows a third embodiment of a curtain body 12, in which a net 125 is additionally provided on one surface for strengthening a connection of each of the plurality of thread circles 122, and then the curtain body 12 may have more strength to resist pulling, and subsequently avoiding breakage from pulling.

Figure 5:
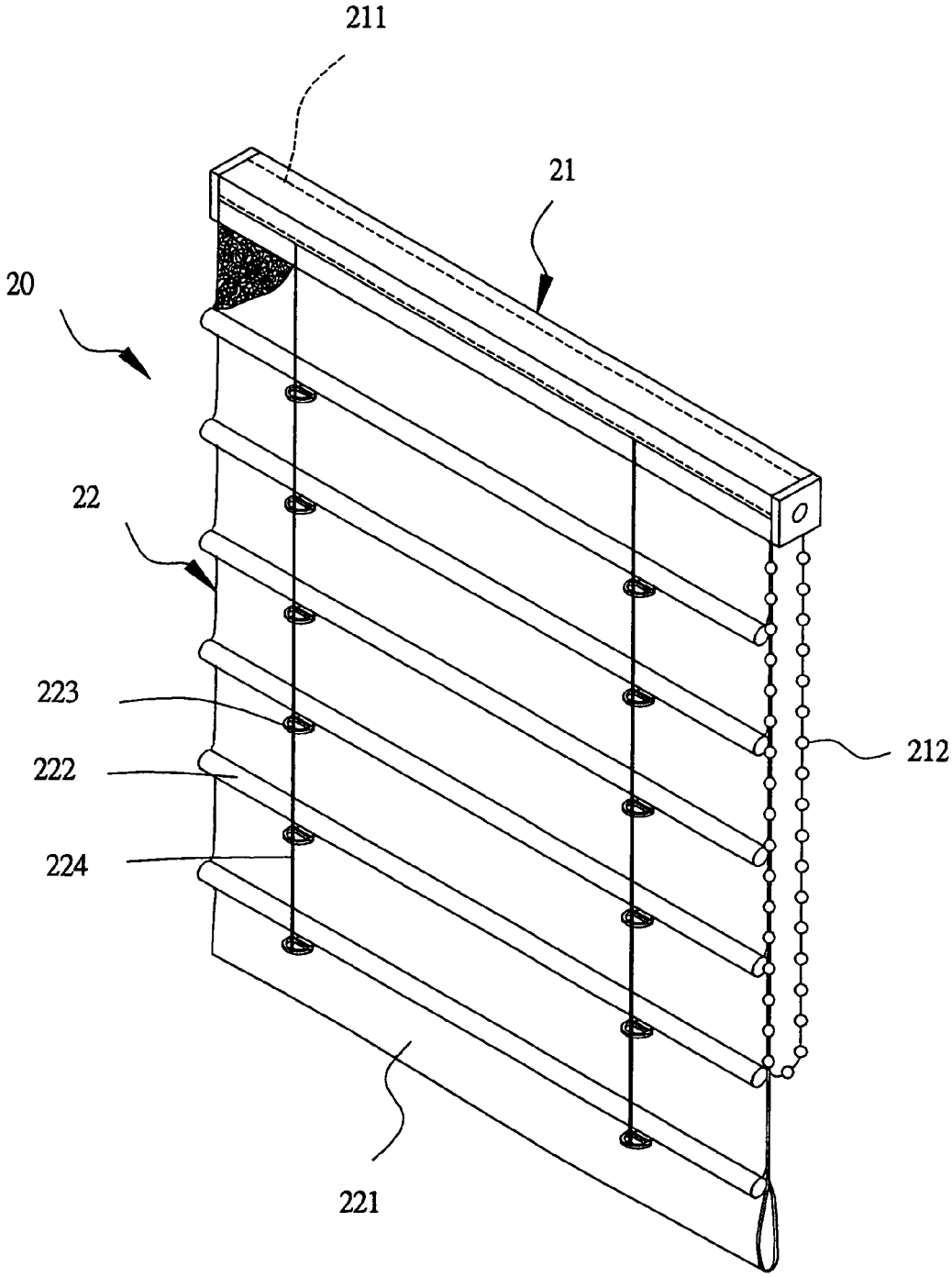
FIG. 5 is a perspective view of a curtain in a fourth embodiment of the present invention.

Finally, FIG. 5 shows a fifth embodiment of a curtain 20 in the present invention, which is a Venetian style blind, including a fixing rod 21, and a curtain body 22.

The fixing rod 21 consists of a winding shaft 211 and an endless bead string 212 wound around one end of the winding shaft 211. The Venetian curtain 22 has a lower end connected with a lower horizontal rod 221, and a plurality of folding horizontal rods 222 spaced apart equidistantly between an upper end and the lower end of the Venetian curtain 22. Each folding rod 222 is provided with two string ears 223 for two strings 224 respectively to pass through, with an upper end of each string 224 fixed on the winding shaft 211 and with the lower end thereof fixed on the lower rod 221. When a user pulls the bead string 212 upwardly or downwardly, the winding shaft 211 is rotated to selectively wind up the two strings 224 at the same time, with the lower rod 221 being pulled up or down to selectively move the folding rods 222 up and down.

Further, it is also necessary to know that the curtain body 12 (22) of the curtain 10 (20) can in advance be made by cutting into a plurality of lengthwise elongate strips (not shown), and then fixed on the fixing rod 11 (21), which is then secured at an upper side of a window frame to become a complete curtain provided with functions of blocking insects from entering and lessening sunlight shining in.

The invention has the following advantages, as can be understood from the aforesaid description.

1. The curtain body 12 (22) can be made to have a predetermined airiness and light-passing quality by designing (increasing and decreasing) the sizes of the plurality of pores 123 so that the curtain body may have good ventilation in case of completely covering a window, while still letting a restricted light pass through without the drawbacks of th conventional curtains that must be shut or opened to adjust a light level, which can reduce privacy.

2. The curtain body 12 (22) has a function of sound absorption and insulation for keeping a room quiet.

3. The curtain body 12 (22) is comparatively heavy so that it can naturally move down to hang flat, and is not apt to be blown or move wildly by a wind, thereby prolonging its using life.

While the preferred embodiment of the invention has been described above, it will be recognized and understood that various modifications may be made therein and the appended claims are intended to cover all such modifications that may fall within the spirit and scope of the invention.

What is claimed is:

1. A curtain for a window frame comprising:

a) a fixing rod connected to a top of the window frame;

b) a curtain body having a plurality of flexible threads intertwined and forming a plurality of irregular loops and a plurality of pores located between the plurality of irregular loops, an upper end of the curtain body is connected to the fixing rod, wherein a predetermined amount of light and a predetermined amount air flow passes through the plurality of pores; and c) two strings, the fixing rod has a winding shaft rotatably connected to the window frame, and an endless bead string wound around one end of winding shaft controlling a rotation of the winding shaft, the curtain body has a lower horizontal rod connected to a bottom thereof and a plurality of middle horizontal rods located on the curtain body between the fixing rod and the lower horizontal rod, the plurality of middle horizontal rods are equally spaced apart, each of the plurality of middle horizontal rods has a first string ear and a second string ear, a first string of the two strings is connected at a first end thereof to the lower horizontal rod, threaded through the first string ear of each of the plurality of middle horizontal rods, and connected at a second end thereof to the fixing rod, a second string of the two strings is connected at a first end thereof to the lower horizontal rod, threaded through the second string ear of each of the plurality of middle horizontal rods, and connected at a second end thereof to the fixing rod, the curtain body is selectively moved upward and downward by rotating the winding shaft.

2. The curtain according to claim 1, wherein the curtain body has two opposing surfaces, a first surface of the two opposing surfaces has a smoother surface than a second surface of the two opposing surfaces, a plurality of first pores of the plurality of pores located on the first surface has a size smaller than a size of a plurality of second pores of the plurality of pores located on the second surface.

3. The curtain according to claim 1, wherein the curtain body has two opposing surfaces, both of the two opposing surfaces are smooth surfaces formed by pressing with heat, a plurality of outer pores of the plurality of pores located on the two opposing surfaces has a size smaller than a size of a plurality of interior pores of the plurality of pores.

4. The curtain according to claim 1, further comprising a net, the curtain body has two opposing surfaces, the net is connected to portions of the plurality of flexible threads located on one of the two opposing surfaces.

5. The curtain according to claim 1, wherein the fixing rod has a winding shaft rotatably connected to the window frame, and an endless bead string wound around one end of winding shaft controlling a rotation of the winding shaft, the curtain body is selectively moved upward and downward by rotating the winding shaft.

* * * * *